United States Patent [19]

Basey

[11] 4,352,485

[45] Oct. 5, 1982

[54] VARIABLE RACK STAIR RAIL ASSEMBLY

[75] Inventor: Gene Basey, Rowland Heights, Calif.

[73] Assignee: Zenith Stairways & Bldg. Products, Inc., Walnut, Calif.

[21] Appl. No.: 157,186

[22] Filed: Jun. 6, 1980

[51] Int. Cl.[3] ..... E04H 17/14;

[52] U.S. Cl. ..... 256/65; 256/67; 256/22

[58] Field of Search ..... 411/907, 908/256; 59; 65; 66; 67; 21; 22; 19

[56] References Cited

U.S. PATENT DOCUMENTS

| | | | |
|---|---|---|---|
| 1,772,159 | 8/1930 | Roth | 256/65 |
| 2,654,579 | 10/1953 | Cremens | 256/65 X |
| 2,855,227 | 10/1958 | Bottom | 256/21 X |
| 4,272,061 | 6/1981 | Suckno | 256/67 |

FOREIGN PATENT DOCUMENTS

| | | | |
|---|---|---|---|
| 2013449 | 9/1971 | Fed. Rep. of Germany | 256/65 |
| 545043 | 7/1922 | France | 256/65 |
| 531911 | 10/1976 | U.S.S.R. | 256/59 |

OTHER PUBLICATIONS

GRC Die Cast Industrial Fasteners and Molded Nylon Fasteners, Gries Reproducer Corp., 125 Beechwood Ave., New Rochelle, N.Y., pp. 1, 2 and 7.

*Primary Examiner*—James Kee Chi

*Attorney, Agent, or Firm*—Poms, Smith, Lande & Rose

[57] ABSTRACT

A variable rake stair rail assembly includes a hand rail, a show rail, a plurality of balusters extending in spaced relation between the shoe and hand rails, and means for joining each baluster to the hand rail and the shoe rail, the joining means comprising a joining element extending into at least one end of each baluster and engaging one of the rails, thus to permit relative angular movement between baluster and rails to provide a variable rake assembly, when the assembly is forced or racked to a slightly different angular configuration of the balusters relative to the hand and shoe rails. In one preferred form, the means for joining comprises a dowel extending into the baluster end and engaging one of the rails. The dowel may be of flexible material. In another form of the invention, the joining means comprises plate means attached to one of the rails and a threaded fastener retained by the rail and extending into the baluster end. The plate may be attached to the rail by threaded members. The hand rail and show rail may preferably define channels into which the baluster ends extend.

22 Claims, 9 Drawing Figures

58'
46
48
58

60

47
42
50
44
40

54
56
52

VARIABLE RACK STAIR RAIL ASSEMBLY

BACKGROUND OF THE INVENTION

The invention relates to building construction and specifically to stair rail assemblies. Such assemblies typically include a hand rail and a shoe rail which are disposed in generally parallel relationship. A plurality of generally vertical balusters extend intermediate the hand rail and the shoe rail. A generally vertical post at the lower extremity of the assembly is referred to as a starting newel.

The prior art includes preassembled variable rake rail assemblies which use balusters that extend into channel shaped hand rails and shoes rails. In one form the prior art utilizes a plurality of pins which extend through the opposed sides of the channels of the hand rail and shoe rail. Each pin extends transversely through an axial extremity of a baluster. Such constructions have not been wholly satisfactory because the construction of such assemblies lends itself primarily to factory assembly of the entire apparatus and shipment fully assembled. Shipment of fully assembled structures is inconvenient for the manufacturer, the building supply dealer, and the contractor. Shipment to so called "Do-it-Yourselfers" of such fully assembled apparatus may be impossible since such individuals will typically not have ready access to a truck or similar transport vehicle. Another disadvantage of the prior art structure is that the pins on which the balusters are pivoted break through and damage the structure upon application of even relatively light loads, such as that applied by a child's weight on the shoe rail. A further disadvantge is that these pins are, at least in some cases, unsightly in appearance. A further disadvantage of prior art devices is that they typically permit relative angular movement and racking in only one direction.

It will thus be seen that the prior art structures which do allow variation in the angle between the baluster and respectively the hand rail and shoe rail have several specific disadvantages in addition to being generally complex and expensive to manufacture.

It is a primary object of the invention to provide apparatus which will allow flexibility in orientation of the balusters with respect to the shoe and hand rails and will at the same time allow shipment in a compact form.

It is another object of the invention to provide apparatus which will be able to withstand substantial loads without resultant damage as in some prior art apparatus.

It is another object of the invention to provide apparatus which may be very easily assembled at the individual construction site so that there is no requirement for assembling the entire apparatus at a manufacturing plant.

Another object of the invention is to provide apparatus which will minimize total construction costs by reducing the total cost of installing a stair rail assembly including the cost for material and labor to install the apparatus including the steps of providing the proper orientation of the shoe rail and hand rail with respect to the steps of a stairway.

Still another object of the invention is to provide apparatus which makes it easy for the user to vary the angle between the shoe and hand rail with respect to the baluster, that is, to rack the assembly.

Another object is to provide a variable rake stair rail assembly which provides for relative angular movement in either direction.

Yet another object of the invention is to provide apparatus which is inexpensive to manufacture.

SUMMARY OF THE INVENTION

The foregoing objects and other objects and advantages which shall become apparent from the detailed description of the preferred embodiment are attained in a variable rake stair rail assembly which includes a hand rail, a shoe rail, a plurality of elongated balusters extending in spaced relation between the rails, and means for joining each baluster to the hand rail and the shoe rail, the joining means comprising a joining element extending into an end of each baluster and engaging one of the rails, thus to permit limited relative angular movement between balusters and rails. The joining means may comprise a dowel extending into at least one end of each baluster engaging one of the channel shaped rails. Each of the dowels are disposed in substantially axially aligned relationship with the axis of each baluster. The dowels may preferrably be of flexible material. The means for joining may further include a second dowel extending into the other end of one of the rails. The dowel may be threaded at least at each axial extremity thereof. The channel in each of the rails may include first and second opposed sides which are disposed in generally parallel relationship and engage the sides of each of the balusters. The channels may further include an elongated recess which has an axis which is disposed in generally parallel relationship to the first and second opposed sides.

In another embodiment, the means for joining each of the balusters to the hand rail and the shoe rail comprise a metallic plate disposed on each of the rails. First fasteners extend through the plate into each of the balusters and second fasteners engage the plate and one of the channel shaped rails. The threaded members may be wood screws. The rails may be channel shaped rails with first and second opposed sides which are disposed in generally parallel relationship. The first and second opposed sides may engage the sides of each of the balusters and the channel shaped members may have a step shaped cross section and include an elongated recess which has an axis which is generally parallel to the first and second opposed sides. The heads of the wood screws may extend into the recess. The balusters may each have an axial extremity which is oblique with respect to the axis of the baluster.

BRIEF DESCRIPTION OF THE ACCOMPANYING DRAWING

DESCRIPTION OF THE PREFERRED EMBODIMENT

Figure 1:
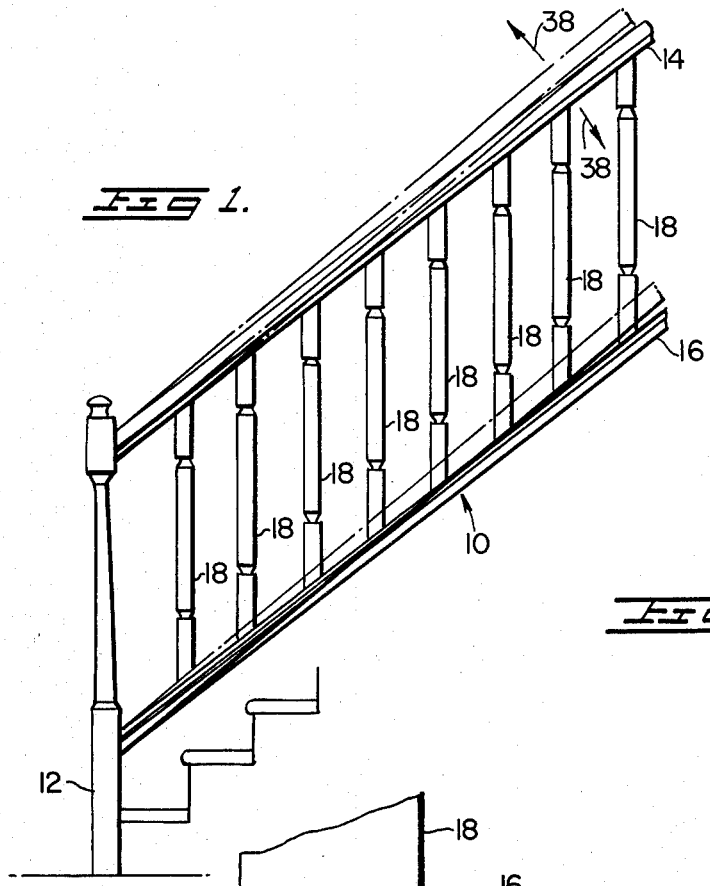
FIG. 1 is a side view of a stair rail assembly in accordance with a first embodiment of the invention.
Figure 2:
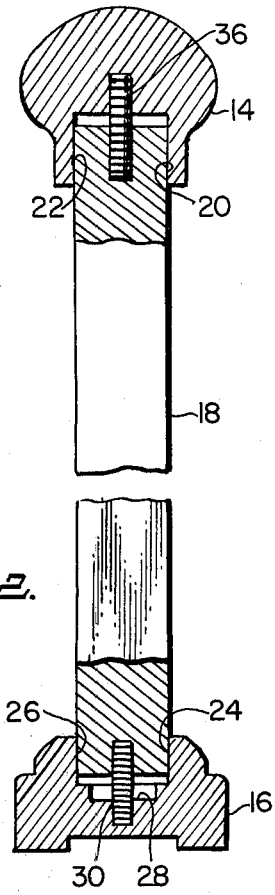
FIG. 2 is a front elevational view in partial section of one of the balusters shown in FIG. 1 and the cooperating shoe and hand rails.

Referring now to FIGS. 1, 2, 3, and 4, there is shown a variable rake stair rail assembly 10 which includes a starting newel 12, a hand rail 14, and a shoe rail 16. A plurality of balusters 18 are disposed in generally parallel relationship and extend intermediate the shoe rail 16 and the hand rail 14. The hand rail 14 includes generally parallel generally planar opposed sides 20, 22 which define a channel. The sides 20, 22 engage the sides of the upper axial extremity of the baluster 18. In a similar manner generally planar generally parallel opposed sides 24, 26 of the shoe rail 16 engage the sides of the lower axial extremity of each baluster 18. In one form of the invention the channel defined by the sides 24, 26 further includes an elongated recess 28 which has the axis thereof disposed in generally parallel relationship to the sides 24, 26. As best seen in FIG. 2, the sides of the channel of the shoe rail 16 have a generally step-shaped contour.

Figure 3:
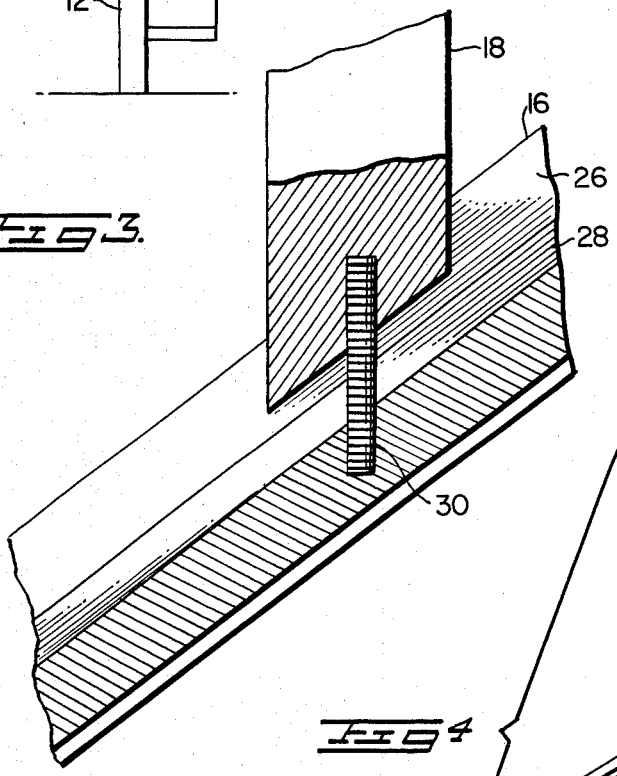
FIG. 3 is a side elevational view in partial section of a portion of the apparatus shown in FIG. 1.
Figure 4:
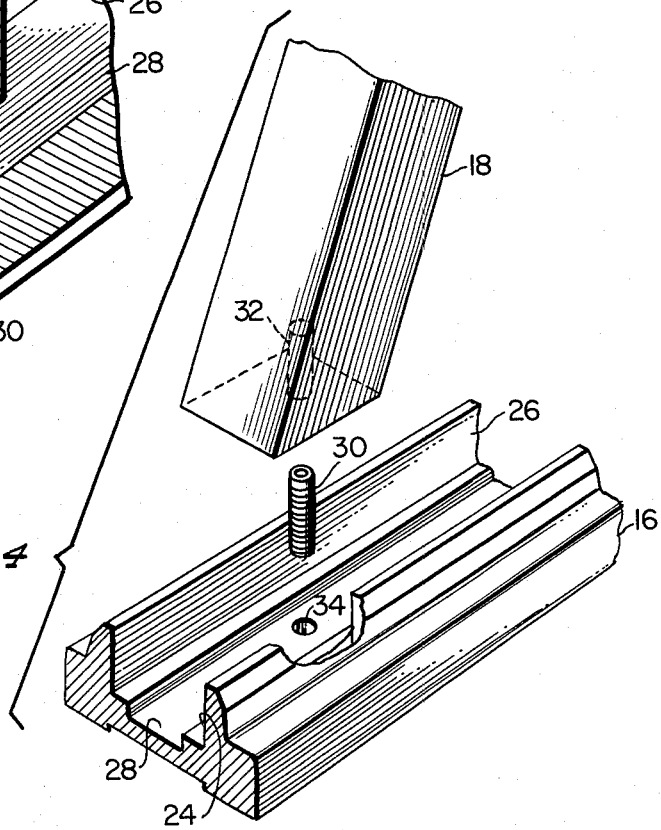
FIG. 4 is a perspective view in exploded relationship of the apparatus shown in FIG. 3.

Each baluster 18 is secured to the shoe rail 16 by means of a dowel 30 which engages a hole 32 in baluster 18 and a hole 34 in shoe rail 16. In a similar manner, a dowel 36 extends intermediate the hand rail 14 and the upper axial extremity of the baluster 18. Ordinarily, the holes such as 32, 34 will be dimensioned to allow some "play" in the assembly and thereby provide room for an adhesive. As shown by the arrows 38 in FIG. 1, the angle intermediate respectively the balusters 18 and the hand rail 14 and shoe rail 16, is variable to facilitate installation of the apparatus on stairways having a wide variation in steepness. As shown in FIGS. 2 and 3, the dowels are so mounted that sufficient space is provided between the baluster end and the rail to permit limited relative angular movement in either direction therebetween. The dowels 30, 36 ordinarily will be manufactured of a flexible material which will not interfere with this movement. Similarly the flexibility of the dowels 30, 36 will increase the resistance to shock loading. At the time of the installation, an adhesive or glue such as a casein glue may be positioned in the holes in which the dowels 30, 36 are disposed to positively lock the balusters 18 into place. The dowels 30, 36 will be provided with an external thread to further improve engagement with the adhesive. The dowels 30, 36 may be manufactured of various synthetic materials such as nylon, polyethylene, or Teflon. (The latter being a trademark of the DuPont Company of Wilmington, Del.). In a preferred form, the dowels 30, 36 are manufactured of thick walled, polyethylene tubing. The tubing allows glue to extend onto both the interior and exterior walls of the tubing resulting in better retention of the dowels 30, 36.

Figures 5, 6, 7, 8, 9:
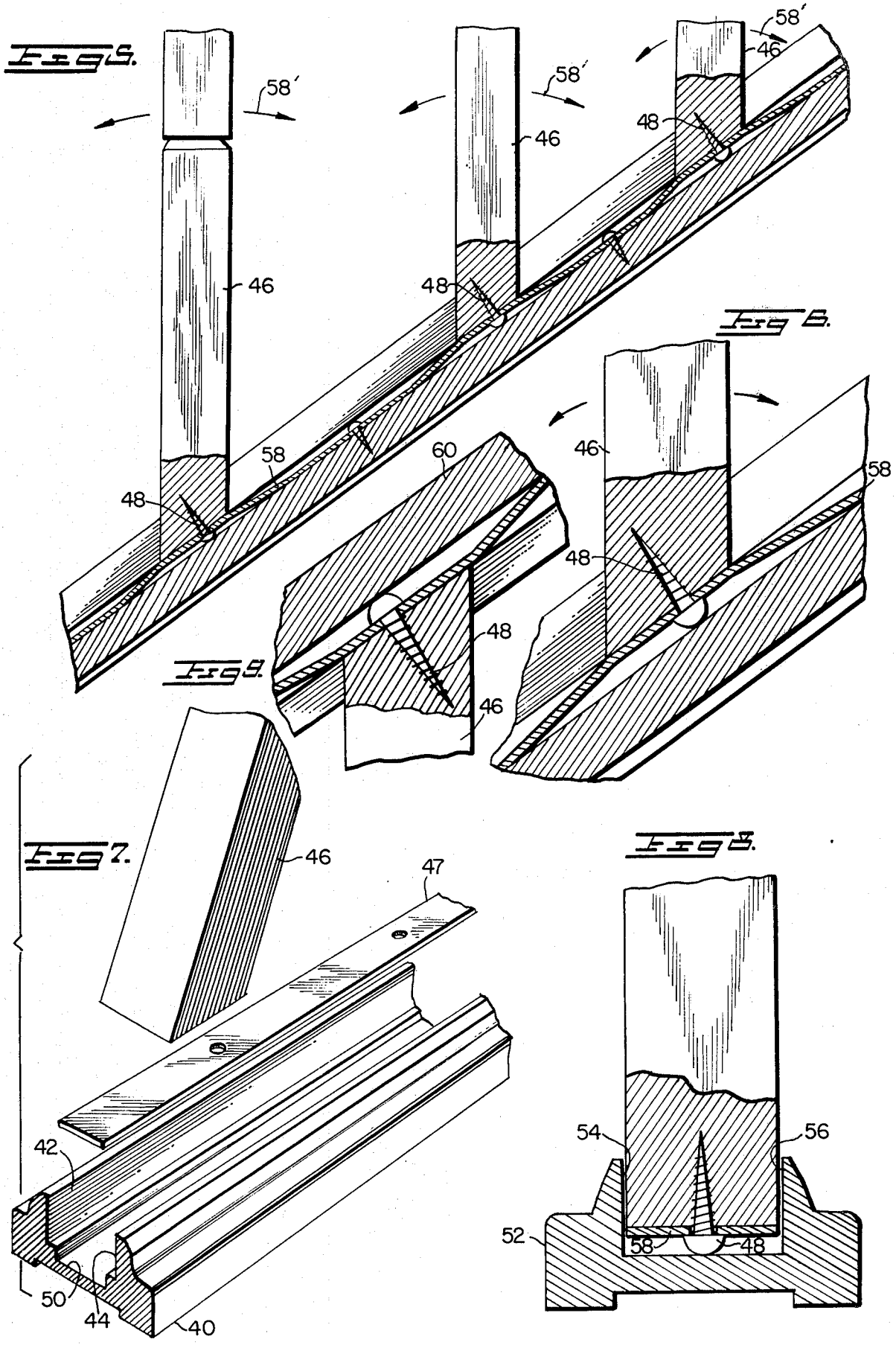
FIG. 5 is a side view in partial section of a second embodiment of the apparatus in accordance with the invention.
FIG. 6 is an enlarged side elevational view, partially in section, showing a portion of the apparatus illustrated in FIG. 5 in greater detail.
FIG. 7 is an exploded perspective view of the apparatus shown in FIG. 6.
FIG. 8 is a front view, partially in section, of a portion of the apparatus similar to that in FIG. 7.
FIG. 9 is a side view, partially in section, showing another portion of the second embodiment.

Referring now to FIGS. 5–8, there is shown a second embodiment of the invention in which a shoe rail 40 has generally parallel planar opposed sides 42, 44 which engage the sides of the balusters 46. A metal strip 47 extends intermediate the sides 42, 44 of the baluster 46 and is fastened in place by wood screws 48. In the preferred form, the metal strip 47 is alternately fastened along the axial extend thereof to a baluster 46 and then the shoe rail 40, as best seen in FIG. 5. In that embodiment each wood screw 48 engaging the shoe rail 40 is disposed at an oblique angle with respect to the axis of the baluster 46. Each wood screw 48 engaging the shoe rail 40 is disposed in normal relationship to the bottom of the channel defined by the sides 42, 44. In the embodiment illustrated in FIGS. 5, 6, and 7 the heads of the wood screws 48 are disposed in an elongated recess 50 which has an axis which is disposed in generally parallel relationship to the sides 42, 44. The screw heads space the baluster end from the rail sufficiently to permit limited relative angular movement in either direction therebetween.

Referring specifically to FIG. 8 there is shown a minor variation of the second embodiment in which shoe rail 52 is provided with a recess having generally planar generally parallel opposed sides 54, 56. A metallic member 58 is fastened to a baluster 46 by means of wood screw 48. Except for the omission of the recess 50, the embodiment of FIG. 8 is generally similar to that of FIG. 7. It will be understood that in those embodiments which include the recess 50 there is a discrete space for the head of the wood screw 48 to facilitate the alignment process during installation. In the embodiment of FIG. 8, sufficient room for the head of the wood screw 48 is provided in single channel defined by the sides 54, 56.

In FIG. 9 there is shown the hand rail 60 which is constructed in a similar manner to the shoe rails shown in FIGS. 7 and 8. The primary difference being that the surface which is most remote from the baluster 46 will have a rounded contour to make it more comfortable for the user.

In operation, the variable rake rail assembly is positioned and as indicated by the arrows 58′ the balusters 46 may be moved to provide the necessary alignment. In this embodiment the metal strip 47 will flex intermediate axially adjacent wood screws 48 to allow the desired alignment. It will be seen that the assembly of the metal strip to the rail 40 and the balusters 46 may be easily accomplished and that the necessary alignment may be established without sacrificing the rigidity of the structure.

The plate 47 or 58 may be manufactured of steel, aluminum or other metallic material. In some forms of the invention the material may even be plastic. In various embodiments of the invention the balusters and rails may be wood, plastic, or metal. In those embodiments of the invention in which metal rails and balusters are used the wood screws will, of course, be replaced by other fasteners.

The invention has been described with reference to its illustrated preferred embodiments. Persons skilled in the art of constructing stair rail assemblies may, upon exposure to the teachings herein, conceive variations in the mechanical development of the components therein. Such variations are deemed to be encompassed by the disclosure, the invention being delimited only by the appended claims.

The inventor claims:

1. A variable rake stair rail assembly which comprises:

a hand rail defining a channel;

a shoe rail defining a channel;

a plurality of elongated balusters extending intermediate the channel in said shoe rail and the channel in said hand rail; and means for joining each of said balusters to said hand rail and said shoe rail, said means for joining comprising a dowel extending into at least one end of each baluster generally parallel to the longitudinal axis of said baluster, and engaging one of said channel shaped rails, at least one end of each said baluster being slightly spaced from the adjacent surface of the hand or shoe rail at the bottom of the channel in said rail.

2. The apparatus according to claim 1 wherein:
said joining means comprises a joining element of flexible material.

3. The apparatus as described in claim 1 wherein:
each of said dowels is disposed in substantially coaxial relationship with a baluster which it engages.

4. The apparatus as described in claim 3 wherein:
said means for joining further includes a second dowel extending into the other end of each of said balusters, said second dowel extending into the other end of said rails.

5. The apparatus as described in claim 4 wherein:
said dowel is threaded at least at each axial extremity thereof.

6. The apparatus as described in claim 1 wherein:
said channel in each of said rails has a step shaped cross section, said channel including first and second opposed sides which are disposed in generally parallel relationship engaging the sides of each of said balusters, said channels further including an elongated recess which has an axis which is disposed in generally parallel relationship to said first and second opposed sides.

7. The apparatus as described in claim 1, wherein:
said dowels are manufactured of a flexible material.

8. The apparatus as described in claim 1, wherein:
at least some of said dowels are tubular.

9. A variable rake stair rail assembly which comprises:
a hand rail defining a channel;
a shoe rail defining a channel
a plurality of elongated balusters extending intermediate the channel in said shoe rail and the channel in said hand rail; and
means for joining each of said balusters to said hand rail and said shoe rail, with the ends of said balusters being slightly spaced from the opposing surfaces of said rails, said means for joining comprising a plate disposed in each of said channel shaped rails, and first fastening means extending through said plate into each of said balusters through the end surface of said baluster, and second fastening means engaging said plate and one of said channel shaped rails, said second fastening means being disposed intermediate said first fastening means along the axial extent of said plate, said joining means providing a predetermined normal orientation for said assembly, but being capable of deformation to permit slight angular adjustments thereof as said assembly is racked.

10. The apparatus as described in claim 9 wherein:
said plate is metallic.

11. The apparatus as described in claim 9 wherein:
said threaded members are wood screws.

12. The apparatus as described in claim 10 wherein:
the channels of said channel shaped rails each include first and second opposed sides which are disposed in generally parallel relationship.

13. The apparatus as described in claim 11 wherein:
said first and second opposed sides engage the sides of each of said balusters and said channel shaped members have a step shaped cross section and include an elongated recess which has an axis which is generally parallel to said first and second opposed sides.

14. The apparatus as described in claim 13 wherein:
the heads of said wood screws extend into said recess.

15. The apparatus as described in claim 13 wherein:
said balusters each have at least one end surface which is oblique with respect to the axis of said baluster.

16. A variable rake stair rail assembly having a predetermined normal stairway pitch and susceptible of being racked by a small acute angle to a steeper or less steep pitch, comprising:
a wooden hand rail,
a wooden shoe rail,
a plurality of elongated wooden balusters extending vertically between said hand rail and said shoe rail, the ends of each of said balusters being cut at a predetermined angle to the axis of the baluster;
means defining recessed surface areas in said hand rail and said shoe rail opposing the ends of said balusters and extending substantially parallel to said ends of said balusters when the balusters and rails are oriented at said normal stairway pitch angle with respect to one another; and
means for mounting said balusters onto said hand rail and said shoe rail with the ends of said balusters close to but spaced from the opposed recessed surface areas, said mounting means including high strength flexible dowels or pins extending generally parallel to the axes of said balusters and extending into and bottoming out into holes in both the ends of said baluster and said rails, said pins or dowels being oriented to provide the normal pitch for a stairway with the balusters vertical, said spacing between said ends of said balusters and said recessed surface areas being substantially that required to permit racking of said stair rail assembly to increase or reduce the pitch of said stair rail assembly by said small acute angle by the flexing of said dowels or pins;
whereby the preassembled stair rail assembly may be employed with stairways of normally varying pitches with the balusters extending vertically and the spacing between the ends of the balusters and the opposing surfaces in the hand and shoe rails being concealed by the enclosing recesses in the hand and shoe rails.

17. A variable rake stair rail assembly having a predetermined normal orientation and susceptible of being racked by a small acute angle to a different angular orientation comprising:
a hand rail,
a shoe rail,
a plurality of elongated balusters extending substantially vertically between said hand rail and said shoe rail, the ends of each of said balusters being cut at an angle to the axis of the baluster substantially conforming to said normal orientation pitch;
means defining recessed surface areas in said hand rail and said shoe rail opposing the ends of said balusters and extending substantially parallel to said ends of said balusters; and
means for mounting said balusters onto said hand rail and said shoe rail with the ends of said balusters close to but spaced from the opposed recessed surface areas, said mounting means including high strength deformable dowels or pins extending generally parallel to the axes of said balusters and extending into and bottoming out into holes in both the ends of said baluster and said rails, said pins or dowels being oriented to provide the normal pitch for a stairway with the balusters vertical, said spacing between said ends of said balusters and said recessed surface areas being substantially that required to permit racking of said stair rail assembly to change the orientation of said assembly by said small acute angle by the flexing of said dowels or pins;

whereby the preassembled stair rail assembly may be employed with normally varying orientations with the spacing between the ends of the balusters and the opposing surfaces in the hand and shoe rails being concealed by the enclosing recesses in the hand and shoe rails.

18. A variable rake stair rail assembly having a predetermined normal stairway pitch and susceptible of being racked by a small acute angle to a steeper or less steep pitch, comprising:

a wooden hand rail;

a wooden shoe rail;

a plurality of elongated balusters extending vertically between said hand rail and said shoe rail, the ends of each of said balusters being cut at an angle to the axis of the baluster substantially conforming to said normal stairway pitch;

means defining recessed surface areas in said hand rail and said shoe rail opposing the ends of said balusters and extending substantially parallel to said ends of said balusters; and means for mounting said balusters onto said hand rail and said shoe rail with the ends of said balusters close to but spaced from the opposed recessed surface areas, said mounting means including high strength deformable mechanical means secured to both the ends of said baluster and to said rails, said mechanical means holding said assembly at each joint thereof to provide the normal pitch for a stairway with the balusters vertical, said spacing between said ends of said balusters and said recessed surface areas being substantially that required to permit racking of said stair rail assembly to increase or reduce the pitch of said stair rail assembly by said small acute angle by the flexing of said deformable mechanical means;

whereby the preassembled stair rail assembly may be employed with stairways of normally varying pitches with the balusters extending vertically and the spacing between the ends of the balusters and the opposing surfaces in the hand and shoe rails being concealed by the enclosing recesses in the hand and shoe rails.

19. The apparatus according to claim 18 wherein:

said mounting means includes plate means attached to said one of the rails, and a threaded fastener retained by the plate and extending into said baluster end.

20. A variable rake stair rail assembly as defined in claim 18 wherein said baluster mounting means includes at least one plate extending along one of said rails in a longitudinal recess, and wood screws extending into the ends of said balusters, and into said rails.

21. A variable rake stair rail assembly as defined in claim 18 wherein said mounting means includes plastic dowels extending longitudinally into said balusters and glue.

22. A variable rake stair rail assembly having a predetermined normal orientation and susceptible of being racked by a small acute angle to a different angular orientation comprising:

a hand rail;

a plurality of elongated balusters extending substantially vertically to said hand rail, the upper end of each of said balusters being cut at an angle to the axis of the baluster substantially conforming to said normal orientation;

means defining recessed surface areas in said hand rail opposing the ends of said balusters and extending substantially parallel to said ends of said balusters; and means for mounting said balusters onto said hand rail with the ends of said balusters close to but spaced from the opposed recessed surface areas, said mounting means including a high strength deformable dowel or pin extending generally parallel to the axes of said balusters and extending into and bottoming out into holes in both the upper end of said baluster and said hand rail, said pin or dowel being oriented to provide the normal pitch for a stairway with the balusters vertical, said spacing between said ends of said balusters and said recessed surface areas being substantially that required to permit racking of said stair rail assembly to change the orientation of said assembly by said small acute angle by the flexing of said dowels or pins;

whereby the preassembled stair rail assembly may be employed with normally varying orientations with the spacing between the upper end of each baluster and the opposing surface in the hand rail being concealed by the enclosing recess in the hand rail.

* * * * *